US010289034B2

(12) United States Patent
Kawanago

(10) Patent No.: US 10,289,034 B2
(45) Date of Patent: May 14, 2019

(54) CLEANING APPARATUS, IMAGE FORMING APPARATUS AND METHOD FOR PRODUCING RIGID BLADE

(71) Applicant: Konica Minolta, Inc., Tokyo (JP)

(72) Inventor: Takashi Kawanago, Fuchu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/987,419

(22) Filed: May 23, 2018

(65) Prior Publication Data

US 2018/0356752 A1 Dec. 13, 2018

(30) Foreign Application Priority Data

Jun. 9, 2017 (JP) ..... 2017-113972

(51) Int. Cl.

*G03G 15/01* (2006.01)
*G03G 15/16* (2006.01)
*G03G 21/00* (2006.01)

(52) U.S. Cl.

CPC ..... *G03G 15/161* (2013.01); *G03G 15/0131* (2013.01); *G03G 21/0011* (2013.01); *G03G 21/0017* (2013.01); *G03G 2215/1661* (2013.01); *G03G 2221/0005* (2013.01)

(58) Field of Classification Search

CPC ..... G03G 15/161; G03G 15/0131; G03G 21/0011; G03G 21/0017; G03G 2215/1661; G03G 2221/0005

See application file for complete search history.

(56) References Cited

U.S. PATENT DOCUMENTS

2003/0113146 A1* 6/2003 White ..... G03G 21/0035 399/353
2005/0249527 A1* 11/2005 Kuramoto ..... G03G 15/1685 399/302
2007/0003315 A1* 1/2007 Iwai ..... G03G 15/0258 399/100
2009/0003898 A1* 1/2009 Kayahara ..... G03G 21/0011 399/327

(Continued)

FOREIGN PATENT DOCUMENTS

JP 06332350 A * 12/1994
JP 2007079282 A * 3/2007
JP 2008046365 A 2/2008

OTHER PUBLICATIONS

JP-2007079282-A, English translation to Usami, Mar. 29, 2007 (Year: 2007).*

*Primary Examiner* — Ryan D Walsh
(74) *Attorney, Agent, or Firm* — Lucas & Mercanti, LLP

(57) ABSTRACT

A cleaning apparatus cleans an image carrier including an elastic layer after a toner image formed on the image carrier is transferred to a transfer material. The cleaning apparatus includes a rigid blade that cleans a residue attached on a surface of the image carrier by contacting the image carrier from which the toner image has been transferred to the transfer material. The rigid blade includes a metal base and a coating layer formed on a surface of the metal base. The coating layer is disposed at least at an edge portion of the base that contacts the image carrier. An upstream part of the edge portion has a rounded shape with a radius of curvature that is less than an average radius of toner particles.

11 Claims, 5 Drawing Sheets

(56) References Cited

U.S. PATENT DOCUMENTS

| | | | | |
|---|---|---|---|---|
| 2017/0329274 | A1* | 11/2017 | Meguro | G03G 21/0017 |
| 2018/0017930 | A1* | 1/2018 | Aoyama | G03G 21/0017 |
| 2018/0067446 | A1* | 3/2018 | Kawanago | G03G 21/0029 |
| 2018/0113402 | A1* | 4/2018 | Seko | G03G 15/161 |

* cited by examiner

CLEANING APPARATUS, IMAGE FORMING APPARATUS AND METHOD FOR PRODUCING RIGID BLADE

BACKGROUND

1. Technological Field

The present invention relates to a cleaning apparatus, an image forming apparatus and a method for producing a rigid blade of the cleaning apparatus.

2. Description of the Related Art

Image forming apparatuses that have been widely used form a toner image on a photoreceptor, transfer the toner image onto an intermediate transfer belt (image carrier) and further transfer the toner image from the intermediate transfer belt onto a sheet.

For such image forming apparatuses, a configuration called blade cleaning has been known in the art to remove residual toner on the intermediate transfer belt after an image is transferred to a sheet, in which a blade that contacts the intermediate transfer belt to scrape off the residual toner is disposed in the downstream in the circumferential (moving) direction of the intermediate transfer belt with respect to a transferring site to a sheet.

In recent years, intermediate transfer belts that include a resin base layer and an elastic layer of a rubber material or the like formed thereon have been used for preventing degradation of the transferring performance. For such intermediate transfer belts with an elastic layer, it has been proposed to use a metal thin blade (rigid blade) for blade cleaning in order to reduce the belt driving torque.

Blade cleaning with a rigid blade may suffer from abrasion of the blade due to an external additive of toner such as silica and resultant scratches of an intermediate transfer belt due to produced abrasion powder. In order to reduce such abrasion powder, the blade has been coated with a material that is harder than the externally-added silica.

However, coating may change the originally intended shape of the blade. For example, a tip of the blade may be rounded.

It is important to control the tip shape of the blade since it largely affects the cleaning performance, and a variety of shapes has been proposed. For example, JP 2008-46365A discloses a scraper that contacts a member to be cleaned to scrape off foreign matters on the surface of the member to be cleaned, in which the scraper includes a coating layer at a tip portion thereof, and the part of the coating layer that contacts the member to be cleaned is formed in a planar shape.

However, in the technique of JP 2008-46365A, the part that contacts the member to be cleaned has a large contact area due to its planar shape, and the high friction tends to promote abrasion of the coating layer. As a result, it is difficult to maintain the cleaning performance for a long time.

SUMMARY

The present invention has been made in view of the above-described problem, and an object thereof is to provide a cleaning apparatus that can maintain the cleaning performance for a long time, an image forming apparatus, and a method for producing a rigid blade.

To achieve at least one of the abovementioned objects, according to an aspect of the present invention, a cleaning apparatus that cleans an image carrier comprising an elastic layer after a toner image formed on the image carrier is transferred to a transfer material includes:

a rigid blade that cleans a residue attached on a surface of the image carrier by contacting the image carrier from which the toner image has been transferred to the transfer material, wherein the rigid blade includes a metal base and a coating layer formed on a surface of the metal base, wherein the coating layer is disposed at least at an edge portion of the base that contacts the image carrier, and wherein an upstream part of the edge portion has a rounded shape with a radius of curvature that is less than an average radius of toner particles, the upstream part being an upstream side in a moving direction of the image carrier with respect to a contact point with the image carrier.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein.

DETAILED DESCRIPTION OF EMBODIMENTS

Hereinafter, one or more embodiments of the present invention will be described with reference to the drawings. However, the scope of the invention is not limited to the disclosed embodiments.

First, the configuration of the image forming apparatus according to the embodiment will be described.

Figure 1:
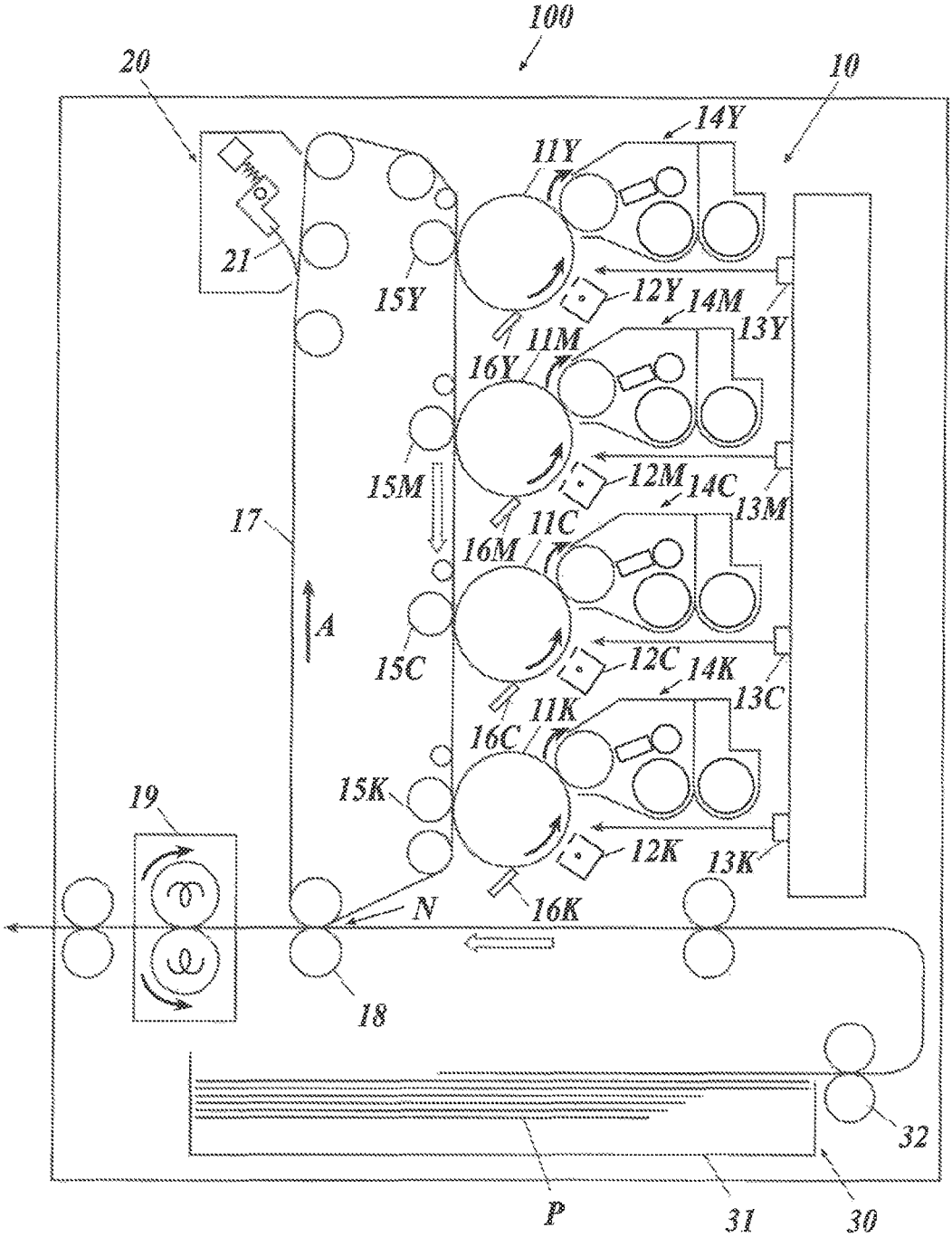
FIG. 1 is a schematic configuration view of an image forming apparatus according to an embodiment of the present invention.
Figure 2:
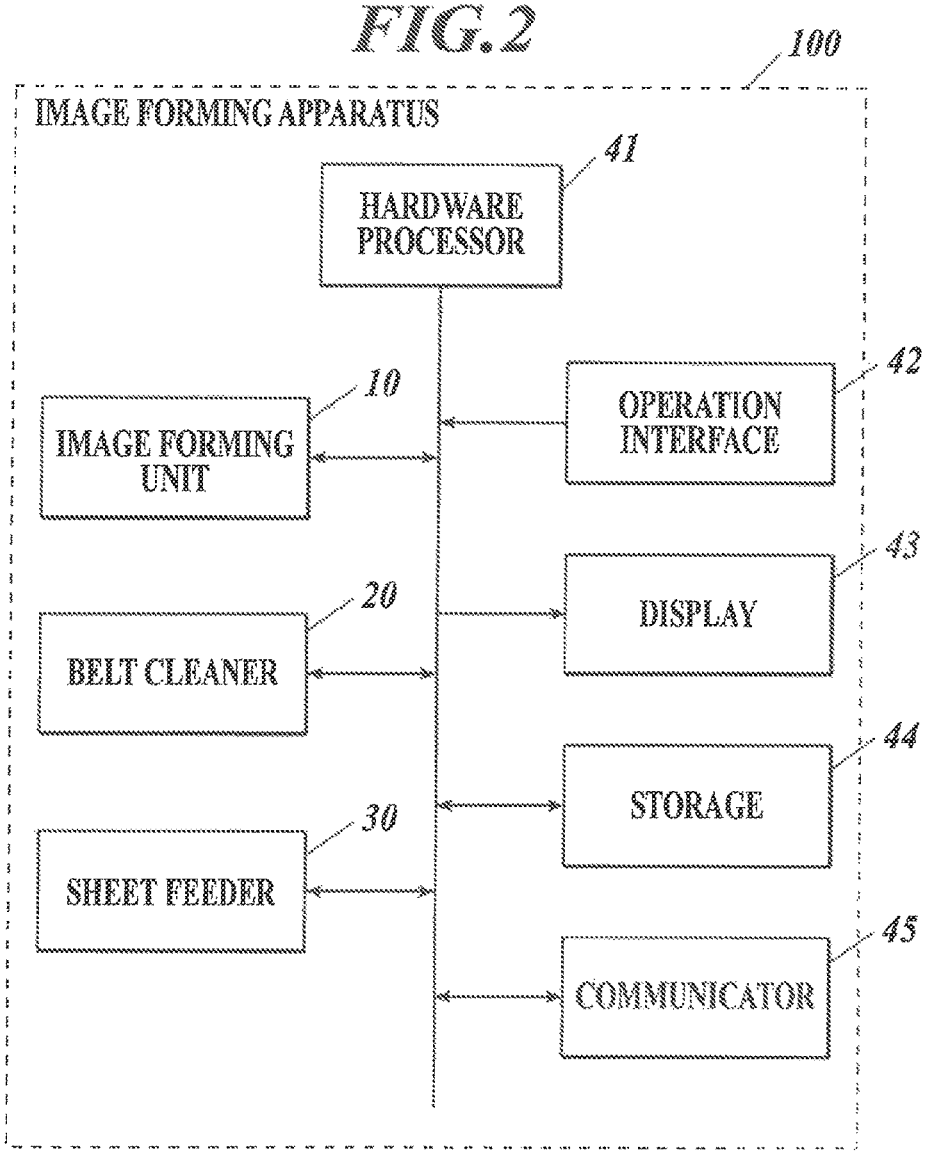
FIG. 2 is a functional block diagram of the control configuration of the image forming apparatus.

FIG. 1 is a schematic configuration view of the image forming apparatus 100. FIG. 2 is a block diagram of the functional configuration of the image forming apparatus 100.

As illustrated in FIG. 1 and FIG. 2, the image forming apparatus 100 includes an image forming unit 10, a belt cleaner 20, a sheet feeder 30, a hardware processor 41, an operation interface 42, a display 43, a storage 44, a communicator 45 and the like, which are connected to each other via a bus.

The image forming unit 10 includes photoreceptor drums 11Y, 11M, 11C, 11K that correspond respectively to colors of yellow (Y) magenta (M), cyan (C) and black (K), chargers 12Y, 12M, 12C, 12K, exposers 13Y, 13M, 13C, 13K, developers 14Y, 14M, 14C, 14K, primary transfer rollers 15Y, 15M, 15C, 15K, photoreceptor cleaners 16Y, 16M, 16C, 16K, an intermediate transfer belt 17 as an image carrier, a secondary transfer roller 18 and a fixation unit 19.

The chargers 12Y, 12M, 12C, 12K uniformly charge photoreceptor drums 11Y, 11M, 11C, 11K.

The exposers 13Y, 13M, 13C, 13K are constituted by respective laser light sources, polygon mirrors, lenses and the like. The exposers 13Y, 13M, 13C, 13K scan the surfaces of the photoreceptor drums 11Y, 11M, 11C, 11K with laser beams to expose them based on image data of the respective colors so as to form electrostatic latent images.

The developers 14Y, 14M, 14C, 14K attach respective color toners to the electrostatic latent images on the photoreceptor drums 11Y, 11M, 11C, 11K to develop them.

The toners used in the developers 14Y, 14M, 14C, 14K include respective toner particles and carriers for charging the toner particles. Toner particles that can be used include ones known in the art that include a coloring agent and, if necessary, a charge controlling agent and a releasing agent, which are incorporated in a binder resin, and an external additive for adjusting the charge property and the fluidity of the toner particles. Examples of external additives include oxide fine particles such as silica and titania. Carriers that can be used include ones known in the art such as binder-type carriers and coating-type carriers.

The average particle size of the toner particles ranges approximately from 5 μm to 10 μm.

The primary transfer rollers 15Y, 15M, 15C, 15K sequentially transfer the toner images of the respective colors formed on the photoreceptor drums 11Y, 11M, 11C, 11K onto the intermediate transfer belt 17 (primary transfer). That is, the toner images of the four colors are overlaid to form a color toner image on the intermediate transfer belt 17.

The photoreceptor cleaners 16Y, 16M, 16C, 16K remove residual toner that is left on the circumferential surfaces of the photoreceptor drums 11Y, 11M, 11C, 11K after an image transfer.

The intermediate transfer belt 17 is an endless belt with an elastic layer, which is supported by rollers (a driving roller, a tension roller and a driven roller) and rotatively driven in the direction indicated by the arrow A in FIG. 1. The detailed configuration of the intermediate transfer belt 17 will be described later.

The secondary transfer roller 18 transfers the color toner image formed on the intermediate transfer belt 17 onto one side of a sheet P (transfer material) fed from the sheet feeder 30 at once (secondary transfer).

The fixation unit 19 heats and presses the toner transferred on the sheet P to fix it to the sheet P.

The belt cleaner 20 removes residues such as residual toner not transferred to the sheet P and paper dust on the intermediate transfer belt 17 after the secondary transfer roller 18 transfers the color toner image to the sheet P, so as to clean the intermediate transfer belt 17. The detailed configuration of the belt cleaner 20 will be described later.

The sheet feeder 30 is disposed in a lower part of the image forming apparatus 100. The sheet feeder 30 includes a detachable sheet feeding cassette 31. The sheets P stored in the sheet feeding cassette 31 are fed to a conveyance path one by one from the top by means of a sheet feeding roller 32.

The hardware processor 41 is constituted by a CPU (central processing unit), a ROM (read only memory), a RAM (random access memory) and the like. The hardware processor 41 integrally controls the operation of the components of the image forming apparatus 100. The CPU reads out a variety of programs stored in the ROM, develops them on the RAM and performs a variety of processing according to the developed programs.

The operation interface 42 is constituted by a touch panel formed over a display screen of the display 43 and a variety of operation buttons such as number buttons and a start button. The operation interface 42 outputs an operation signal corresponding to a user operation to the hardware processor 41.

The display 43 is constituted by an LCD (liquid crystal display). The display 43 displays a variety of screens according to a display signal input from the hardware processor 41.

The storage 44 is constituted by a storage device such as a non-volatile semiconductor memory and a hard disk. The storage 44 stores data and the like relating to the variety of processing.

The communicator 45 sends and receives data to and from an external apparatus connected to a network such as a LAN (local area network).

Configuration of Intermediate Transfer Belt

Next, the configuration of the intermediate transfer belt 17 will be described.

Figure 3:
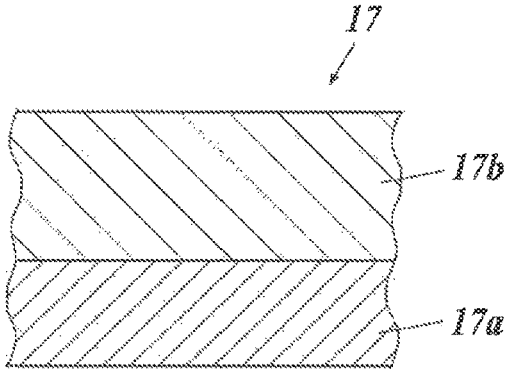
FIG. 3 is a cross-sectional view of an intermediate transfer belt.

FIG. 3 is a cross-sectional view of an intermediate transfer belt 17. In FIG. 3, the upper side corresponds to an outer peripheral side of the intermediate transfer belt 17.

For example, as illustrated in FIG. 3, the intermediate transfer belt 17 may be constituted by an elastic belt that includes a base layer 17*a* of polyimide (PI), polyphenylene sulfide (PPS) or the like and an elastic layer 17*b* of acrylonitrile-butadiene copolymer rubber (NBR), chloroprene rubber (CR) or the like.

In order to ensure the good conveyance property and the good workability in replacement of the intermediate transfer belt 17, it is preferred that the thickness of the base layer 17*a* ranges approximately from 50 μm to 100 μm. In order to improve the high transferring performance against uneven sheets P, it is preferred that the thickness of the elastic layer 17*b* ranges approximately from 100 μm to 500 μm.

In order to reduce the tackiness, it is preferred to provide a surface layer having a hardness greater than the elastic layer 17*b* on the surface of the elastic layer 17*b*. For example, it is preferred to provide an oxide layer with a thickness of 2 μm to 20 μm or a coating layer of fluororesin or the like with a thickness of 2 μm to 20 μm on the surface of the elastic layer 17*b*.

The intermediate transfer belt 17 may be constituted by any belt that has desired transferring properties, and the material and the thickness thereof are not limited to the above examples.

The surface hardness of the intermediate transfer belt 17 (surface hardness of the elastic layer 17*b* or the surface layer) can be measured, for example, by the nanoindentation method. The nanoindentation method is a testing method for determining the mechanical properties of a material, which involves continuously measuring the testing force (force loaded to an indenter) and the depth of penetration (displacement of the indenter) while placing a predetermined load on the indenter to penetrate the surface of the material to form an indentation, and analyzing a penetration curve thus obtained.

Specifically, it is preferred that the surface hardness of the intermediate transfer belt 17 ranges from 70 MPa to 150 MPa. When the surface hardness is less than 70 MPa, i.e. the surface of the intermediate transfer belt 17 is too soft, toner deforms the surface of the intermediate transfer belt 17 to escape away through the edge portion of the rigid blade 21 (described later) so as to cause imperfect cleaning. When the surface hardness is greater than 150 MPa, i.e. the surface is too hard, the surface of the intermediate transfer belt 17 cannot follow occasional uneven contact in the edge direction of the non-deformable rigid blade 21. Toner escapes through a resultant minute gap so as to cause imperfect cleaning.

Configuration of Belt Cleaner

Next, the configuration of the belt cleaner 20 will be described.

Figure 4:
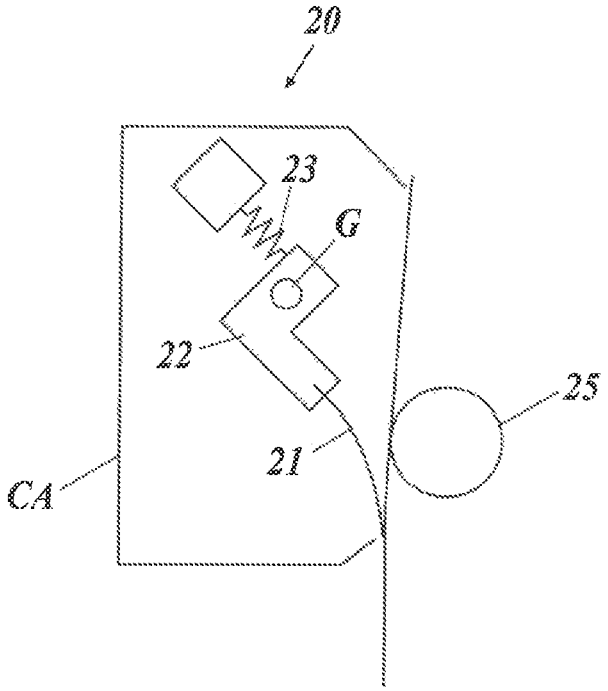
FIG. 4 illustrates the configuration of a belt cleaner.

FIG. 4 is a schematic configuration view of the belt cleaner 20.

The components of the belt cleaner 20 are long in the width direction that is orthogonal to the rotating direction (moving direction) and parallel to the surface of the intermediate transfer belt 17.

As illustrated in FIG. 4, the belt cleaner 20 includes a casing CA and a rigid blade 21, a blade holder 22, a biasing spring 23 and the like that are housed in the casing CA.

The belt cleaner 20 further includes a blade counter roller 25 that is opposed to the casing CA (rigid blade 21) across the intermediate transfer belt 17.

The rigid blade 21, which is a cleaning blade constituted by a metal thin plate, is provided to scrape off and remove residues on the intermediate transfer belt 17 by contacting the tip to the rotating intermediate transfer belt 17. The rigid blade 21 is held pivotably about a pivot G by the blade holder 22. The detailed configuration of the rigid blade 21 will be described later.

The blade holder 22, which holds the rigid blade 21 at one end, is pivotable about the pivot G. The blade holder 22 is engaged with a biasing spring 23 at the other end, which provides a pressing force (contact pressure) of the rigid blade 21 against the intermediate transfer belt 17.

For example, the biasing spring 23 is constituted by a tension coil spring. The biasing spring 23 provides an anticlockwise rotation torque to the blade holder 22 and the rigid blade 21 so that the rigid blade 21 contacts the intermediate transfer belt 17 at a constant pressure.

This constant-pressure contact (spring-forced contact) allows maintaining the contact pressure at a suitable level regardless of the environment. Instead of a tension coil spring, contact-pressure contact may be achieved by any spring such as a compression coil spring.

Near a bottom of the casing CA, a screw (not shown) is provided to discharge the residues scraped off by the rigid blade 21 to the outside of the casing CA.

The blade counter roller 25 is opposed to the rigid blade 21 across the intermediate transfer belt 17.

It is preferred that the blade counter roller 25 is slightly deviated from the tip of the rigid blade 21 by approximately 1 mm to the downstream in the moving direction of the intermediate transfer belt 17.

In this position, the blade counter roller 25 can reduce the occurrence of an so-called staple-shaped escape, in which a micro bump on the blade counter roller 25 or the intermediate transfer belt 17 lifts the rigid blade 21 to cause an escape at the both sides of the micro bump.

Configuration of Rigid Blade

Next, the configuration of the rigid blade 21 will be described.

Figure 5:
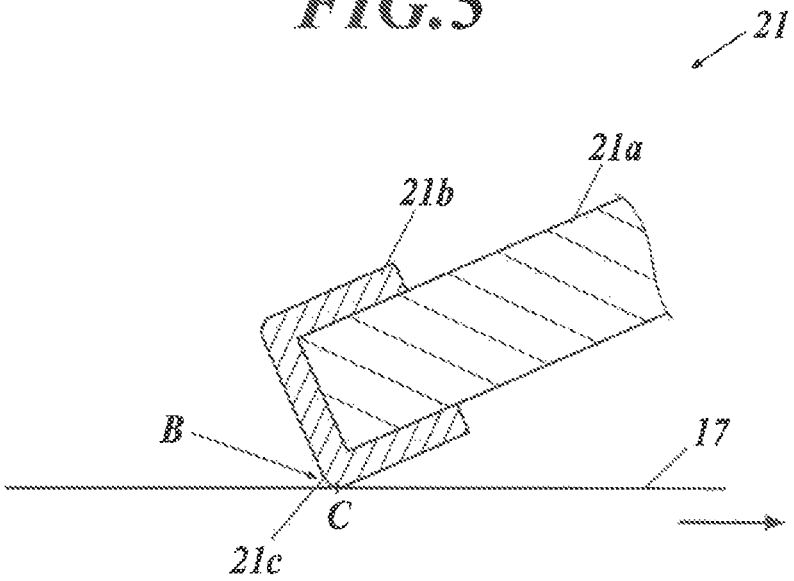
FIG. 5 is a schematic view of a rigid blade, illustrating the configuration thereof.

FIG. 5 is an enlarged schematic view of the rigid blade 21, illustrating the configuration thereof.

As illustrated in FIG. 5, the rigid blade 21 includes a base 21*a* and a coating layer 21*b* formed on the surface of the base 21*a*.

In terms of hardness, processability and cost, materials that can be used for the base 21*a* include metals such as SUS (stainless steel). When in use, the base 21*a* made of such a material is scratched by an external additive of toner such as silica, and a structurally defective part of the base 21*a* is released (i.e. worn away) to be abrasion powder. Since it has been found that the intermediate transfer belt 17 is damaged by such abrasion powder, a coating layer 21*b* is provided on the surface of the base 21*a* in order to improve the abrasion resistance (to reduce production of abrasion powder).

The material of the coating layer 21*b* is harder than the base 21*a*. Examples of such materials include a hard carbon coating containing amorphous carbon such as diamond-like carbon (DLC).

It is preferred that the thickness of the coating layer 21*b* ranges from 2 μm to 10 μm. When the thickness of the coating layer is greater than 10 μm, the coating layer is too thick compared to the size of the rigid blade 21, which may cause an edge separation. When the thickness is less than 2 μm, the coating layer is too thin to function as a coating layer.

While the coating layer 21*b* may or may not cover the entire surface of the base 21*a*, it covers at least an edge portion B of the base 21*a* that contacts with the intermediate transfer belt 17.

In a part 21*c* of the edge portion B, which an upstream side in the moving direction of the intermediate transfer belt 17 with respect to a contact point C with the intermediate transfer belt 17, the coating layer 21*b* has a rounded shape with a radius of curvature that is less than the average radius of toner particles. The lowest radius of curvature of the part 21*c* is approximately 1 μm.

It is preferred that the thickness of the rigid blade 21 ranges from 70 μm to 200 μm. When the thickness of the rigid blade 21 is greater than 200 μm, the rigid blade 21 is too thick to follow an uneven shape in the longitudinal direction. When the thickness is less than 70 μm, the rigid blade 21 is so thin that edge separation occurs. These result in the degraded performance of removing the residues.

In terms of good processability, low plating cost and low damage to the intermediate transfer belt 17, it is preferred that the Vickers hardness of the rigid blade 21 ranges from 100 HV to 3000 HV.

A phenomenon that the intermediate transfer belt 17 suffers from in use is the occurrence of minute cracks (hereinafter referred to as microcracks) in the surface. In order to prevent the rigid blade 21 from being hooked by such a microcrack, it is necessary to reduce the initial angle (contact angle) between the rigid blade 21 and the intermediate transfer belt 17 as narrow as possible within the range in which a body of the rigid blade 21 does not contact the intermediate transfer belt 17. Specifically, it is preferred that the contact angle ranges from 5° to 45°, more preferably from 10° to 25°.

Further, it is preferred that the contact pressure of the rigid blade 21 against the intermediate transfer belt 17 ranges from 3 N/m to 40 N/m, which is the range of ordinary contact pressure in electrophotography, more preferably from 10 N/m to 25 N/m.

Method for Producing Rigid Blade

A method for producing the rigid blade 21 will be described.

Figure 6A:
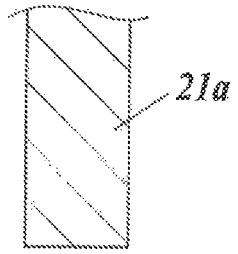
FIG. 6A illustrates a method for producing the rigid blade.
Figure 6B:
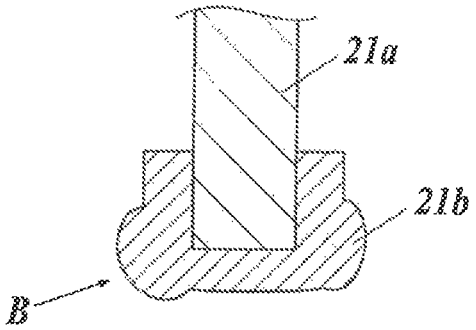
FIG. 6B illustrates the method for producing the rigid blade.
Figure 6C:
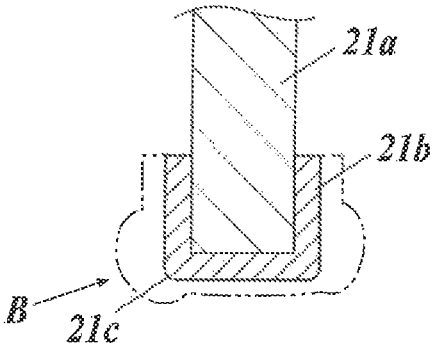
FIG. 6C illustrates the method for producing the rigid blade.

FIG. 6A to FIG. 6C illustrate the method for producing the rigid blade 21.

First, as illustrated in FIG. 6A, the base 21*a* constituted by a metal thin plate of SUS or the like is provided.

Then, as illustrated in FIG. 6B, the coating layer 21*b* is formed on the surface of the base 21*a* (at least in the edge portion B of the base 21*a* that contacts the intermediate transfer belt 17) (first step).

Then, as illustrated in FIG. 6C, the coating layer 21*b* in the edge portion B is processed by buffing or the like so that the part 21*c* of the edge portion B has a rounded shape with a radius of curvature that is less than the radius of toner particles (second step).

Next, the operation of the belt cleaner 20 of the embodiment will be described.

The belt cleaner 20 of the embodiment cleans the intermediate transfer belt 17, in which the rigid blade 21 scrapes off and removes residues that have not transferred from the intermediate transfer belt 17 to a sheet P.

Figure 7A:
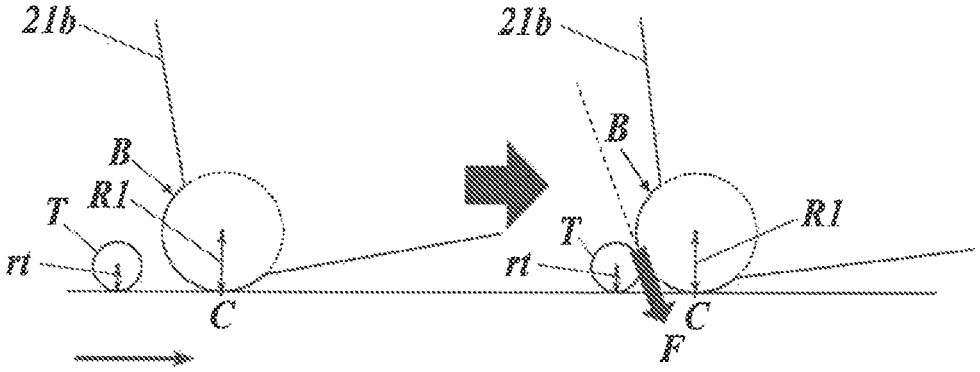
FIG. 7A illustrates the function of the rigid blade.

If the edge portion B of the rigid blade 21 had a rounded shape with a radius of curvature (R1) that is equal to or greater than the average radius (rt) of toner particles as illustrated in FIG. 7A, toner would be subjected to a force F in the direction of pressing down the intermediate transfer belt 17. As a result, silica that is added to the toner T would be more likely to be aggregated.

Figure 7B:
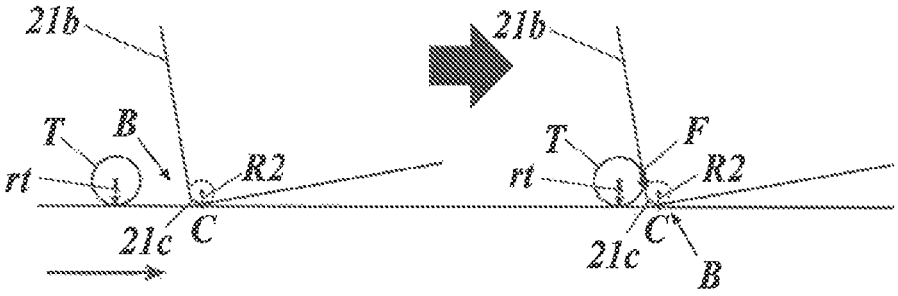
FIG. 7B illustrates the function of the rigid blade.

In contrast, the edge portion B of the rigid blade 21 of the embodiment is configured such that the part 21*c*, which the upstream side in the moving direction of the intermediate transfer belt 17 with respect to the contact point C with the intermediate transfer belt 17, has a rounded shape with a radius of curvature (R2) that is less than the average radius (rt) of toner particles as described above. This configuration reduces the force F that acts on the toner T in the direction of pressing down the intermediate transfer belt 17 as illustrated in FIG. 7B and can therefore reduce aggregation of silica.

EXAMPLES

Hereinafter, examples of the present invention and comparisons will be described.

Evaluation of Cleaning Performance

An image forming apparatus (BIZHUB PRESS C8000) was used. Rigid blades of Example 1, Example 2 and Comparison 1 to Comparison 7, which had a thickness of the coating layer, a radius of curvature and a processing condition as listed in Table 1, were used to form an image on 600000 sheets. After the image formation, the presence or absence of an image formation defect was evaluated. The results are shown in Table 1.

The intermediate transfer belt used in the evaluation included an elastic layer (nitrile-butadiene rubber, NBR) and a hardened surface having a surface hardness of 150 MPa.

The rigid blade used in the evaluation was constituted by a base of SUS304 (stainless steel) coated with DLC. The contact angle was 15°, and the contact pressure was 20 N/m.

The average particle size of the toner particles was 6.2 μm (average radius: 3.1 μm).

Evaluation Criteria

○: No image defect occurred in the image formation.

x: An image defect occurred in the image formation.

TABLE 1

| | THICKNESS (μm) | AVERAGE RADIUS OF TONER (μm) | RADIUS OF CURVATURE (μm) | CONDITIONS | EVALUATION |
|---|---|---|---|---|---|
| EXAMPLE 1 | 4 | 3.1 | 1.5 | PROCESSED | ○ |
| EXAMPLE 2 | 8 | 3.1 | 2 | PROCESSED | ○ |
| COMPARISON 1 | 0 | 3.1 | 0 | NO COATING LAYER | x |
| COMPARISON 2 | 2 | 3.1 | 4 | UNPROCESSED | x |
| COMPARISON 3 | 6 | 3.1 | 11 | UNPROCESSED | x |
| COMPARISON 4 | 10 | 3.1 | 19 | UNPROCESSED | x |
| COMPARISON 5 | 2 | 3.1 | 0.5 | PROCESSED (OVER-PROCESSED) | x |
| COMPARISON 6 | 12 | 3.1 | 6 | PROCESSED (UNDER-PROCESSED) | x |
| COMPARISON 7 | 20 | 3.1 | 8 | PROCESSED (UNDER-PROCESSED) | x |

Results

In Comparison 1, which had no coating layer, a belt scratch occurred in the beginning of the image formation.

In Comparison 2 to Comparison 4, which had a non-polished coating layer, aggregation of silica occurred since the radius of curvature of the rounded edge portion was too large.

In Comparison 5, which had an edge portion that is too shape due to over-polishing, the blade bit into the belt in the beginning of image formation.

In Comparison 6 and Comparison 7, which had an edge portion with a radius of curvature that is too large although they were polished, aggregation of silica occurred.

As described above, the image forming apparatus 100 of the embodiment, which forms an image on a sheet P by transferring a toner image formed on the intermediate transfer belt 17 including the elastic layer 17*b* in the surface, includes: the rigid blade 21 that contacts the intermediate transfer belt 17 from which the toner image has been transferred to the sheet P so as to remove residues on the surface of the intermediate transfer belt 17. The rigid blade 21 includes the metal base 21*a* and the coating layer 21*b* formed on the surface of the base 21*a*. The coating layer 21*b* is formed at least in the edge portion B of the base 21*a* that contacts the intermediate transfer belt 17. The part 21*c* of the edge portion B, which is the upstream side in the moving direction of the intermediate transfer belt 17 with respect to the contact point C with the intermediate transfer belt 17, has a rounded shape with a radius of curvature that is less than the average radius of toner particles.

This configuration can reduce a force that acts on toner in the direction of pressing down the intermediate transfer belt 17 and can therefore reduce aggregation of silica.

As a result, the coating layer 21*b* can prevent the intermediate transfer belt 17 from being damaged while suppressing degradation of the cleaning performance since it can reduce aggregation of silica.

In other words, the cleaning performance can be maintained for a long time.

In the embodiment, the coating layer 21*b* is harder than the base 21*a*. The coating layer 21*b* is constituted by hard carbon coating containing amorphous carbon.

Therefore, the abrasion resistance of the rigid blade 21 can be improved.

In the embodiment, the thickness of the coating layer 21*b* is equal to or greater than 2 μm in the downstream side in the moving direction of the intermediate transfer belt 17 with respect to the contact point C.

This configuration is suitable for ensuring the function of the coating layer 21*b*.

In the embodiment, the elastic layer 17*b* has a surface hardness measured by the nanoindentation method of from 70 MPa to 150 MPa.

This configuration is suitable and does not cause any cleaning failure.

In the embodiment, the method for producing the rigid blade 21 of the image forming apparatus 100 involves: a first step of forming the coating layer 21*b* in the edge portion B of the base 21*a*, and a second step of buffing the coating layer 21*b* in the edge portion B formed in the first step, wherein in the second step, the part 21*c* of the edge portion B is formed in a rounded shape with a radius of curvature that is less than the average radius of toner particles, in which the part 21*c* is the upstream side in the moving direction of the intermediate transfer belt 17 with respect to the contact point C with the intermediate transfer belt 17.

This configuration reduces a force that acts on toner in the direction of pressing down the intermediate transfer belt 17. Therefore, it is possible to produce the rigid blade 21 that can reduce aggregation of silica.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese patent application No. 2017-113972, filed on Jun. 9, 2017, is incorporated herein by reference in its entirety.

What is claimed is:

1. In an image forming device including an image carrier having an elastic layer on which an image is formed using toner particles having a predetermined size with an average radius, a cleaning apparatus that cleans the image carrier after a toner image formed on the image carrier is transferred to a transfer material, the cleaning apparatus comprising:

a rigid blade that cleans a residue attached on a surface of the image carrier by contacting the image carrier from which the toner image has been transferred to the transfer material, wherein the rigid blade comprises a metal base and a coating layer formed on a surface of the metal base, and the rigid blade has a thickness in a range of 70 μm to 200 μm, wherein the coating layer is disposed at least at an edge portion of the rigid blade that contacts the image carrier, and wherein an upstream part of the edge portion has a rounded shape with a radius of curvature that is less than the average radius of toner particles, the upstream part being an upstream side in a moving direction of the image carrier with respect to a contact point with the image carrier.

2. The image forming device according to claim 1, wherein the coating layer is harder than the base.

3. The image forming device according to claim 1, wherein the coating layer is constituted by a hard carbon coating containing amorphous carbon.

4. The image forming device according to claim 1, wherein a thickness of the coating layer is equal to or greater than 2 μm in a downstream side in the moving direction of the image carrier with respect to the contact point.

5. The image forming device according to claim 1, wherein a surface of the image carrier has a hardness measured by a nanoindentation method of from 70 MPa to 150 MPa.

6. An image forming apparatus, comprising the cleaning apparatus according to claim 1 and the image carrier having the elastic layer.

7. A method for producing the rigid blade of the cleaning apparatus according to claim 1, comprising:

a first step of forming the coating layer at least on the edge portion of the base; and a second step of processing the coating layer in the edge portion formed in the first step, wherein in the second step, the upstream part of the edge portion is formed in a rounded shape with a radius of curvature that is less than the average radius of toner particles, the upstream part being the upstream side in the moving direction of the image carrier with respect to the contact point with the image carrier.

8. The method for producing the rigid blade according to claim 7, wherein in the second step, the coating layer in the edge portion is processed by buffing.

9. The image forming device according to claim 1, wherein the metal base is a thin plate having two opposing main surfaces, the edge portion being arranged at a free end of the rigid blade, an edge surface of the thin plate extends between the two main surfaces at the free end in a thickness direction of the rigid blade, and the coating portion extends over a corner between one of the main surfaces and the edge surface to form the edge portion that contacts the image carrier.

10. The image forming device according to claim 9, wherein a thickness of the coating layer is in a range of 2 μm to 10 μm.

11. The image forming device according to claim 1, wherein the image carrier is an intermediate transfer belt and a contact angle between the rigid blade and the intermediate transfer belt is in a range of 10° to 25°.

* * * * *